United States Patent [19]

Maxwell, Jr.

[11] 4,021,867

[45] May 10, 1977

[54] CONVERTIBLE CRADLE

[76] Inventor: Oscar Benton Maxwell, Jr., 5309 Robins Drive, Raleigh, N.C. 27610

[22] Filed: Sept. 8, 1975

[21] Appl. No.: 611,522

[52] U.S. Cl. ..... 5/106; 297/270

[51] Int. Cl.[2] ..... A47N 9/02

[58] Field of Search ..... 5/106, 105; 297/269, 297/270

[56] References Cited

UNITED STATES PATENTS

| | | | |
|---|---|---|---|
| 149,178 | 3/1874 | Wright | 297/270 |
| 200,805 | 2/1878 | Sprengard | 5/106 |
| 279,665 | 6/1883 | Reed | 5/106 |
| 391,292 | 10/1888 | Berens | 5/106 |
| 2,486,466 | 11/1949 | Davis | 5/106 |
| 2,930,612 | 3/1960 | Goodrich | 297/270 |
| 3,335,433 | 8/1967 | Stopek | 5/105 |
| 3,692,359 | 9/1972 | Boucher | 297/270 |

FOREIGN PATENTS OR APPLICATIONS

| | | | |
|---|---|---|---|
| 282,204 | 7/1913 | Germany | 297/270 |
| 200,024 | 7/1908 | Germany | 5/106- |

*Primary Examiner*—Paul R. Gilliam
*Assistant Examiner*—Andrew M. Calvert
*Attorney, Agent, or Firm*—Edward H. Duffield

[57] ABSTRACT

An improved infant rocking cradle is disclosed in which means are provided for converting the cradle to a non-rocking, stable configuration for use as a chest, cabinet, table, or the like.

6 Claims, 4 Drawing Figures

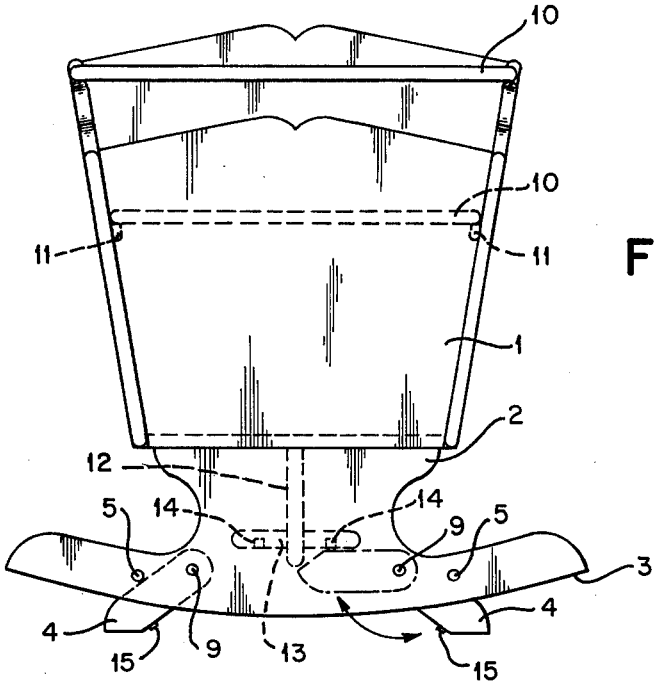
FIG. 1
FIG. 2
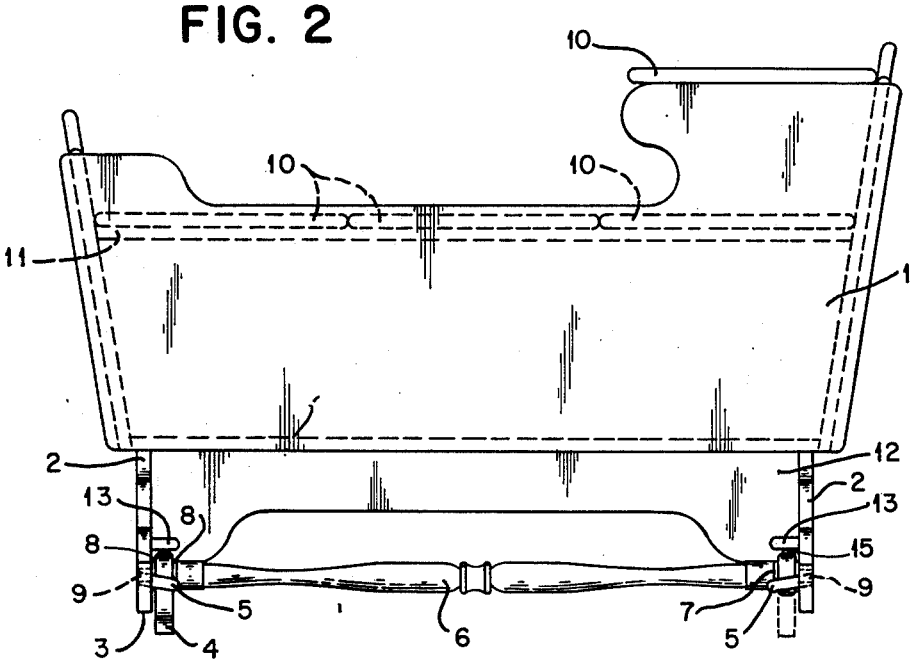

CONVERTIBLE CRADLE

BACKGROUND OF THE INVENTION

This invention relates in general to convertible furniture and in particular to convertible cradle devices.

PRIOR ART

A wide variety of means for converting rocking cradles from rockable to fixed configurations exists in the prior art. Some of these have taken the form of complicated devices for locking the cradle to a stand; some have been simple devices, such as legs affixed to the rockers, which may be employed for converting the cradle to a fixed device and back to a movable operation.

A difficulty with the prior art has been in the stability of the cradle when converted from the rocking configuration to the fixed configuration. Pivoting legs or braces of blocks have been utilized prior to this invention. However, prior to this invention. However, prior art devices are either more complicated in construction or less sturdy and able to take torsional loads and side loads, which tend to loosen a pivoting leg. Such devices provide unstable support in a direction parallel with the axis of the pivot utilized. Also, prior art has lacked suitable stabilization means to lock the legs, which are often used, in a fixed position relative to the rockers and to the supporting floor or surface on which the rockers rest.

OBJECTS OF THE INVENTION

In light of the foregoing shortcomings of the known prior art, it is an object of this invention to provide an improved convertible cradle device in which improved support for the rocker conversion means is included with an improved mounting for the legs which are used which provides more stable operation, easier conversion, and simpler design than the aforementioned prior art.

It is a further object of this invention to provide an improved means of affixing the legs which are utilized in the stable configuration, together with an improved means for locking the legs in position.

BRIEF DESCRIPTION OF THE DRAWINGS

FIG. 1 is an end view of a preferred embodiment of the invention illustrating the action of the pivoting legs.

FIG. 2 is a side view of the preferred embodiment illustrated in FIG. 1 showing the details of supporting the legs and the manner of affixing and locking them to the rocker structure.

Turning to FIG. 1, a preferred embodiment of the present invention is shown in a view looking toward one end of a convertible cradle. The cradle construction comprises an open-topped body portion 1 having ends, side walls, and a bottom panel. Affixed to the bottom panel is a main rocker body 2 made of a flat piece of wood or other material and having an arcuate edge contour 3 forming the convex rocker surface intended to be in contact with the floor or other suitable support surface. Movable legs 4 are supported on pivots 9 passing through apertures in each leg and are held in position by an angled wedge pin 5 when they are in the engaged position illustrated in the solid lines in FIG. 1. In the folded or disengaged position illustrated in phantom lines in FIG. 1, the legs 4 may be held by suitable magnetic latches or friction latches illustrated as cooperating magnet elements 14 and 15 which are well-known in the furniture art.

Figure 3:
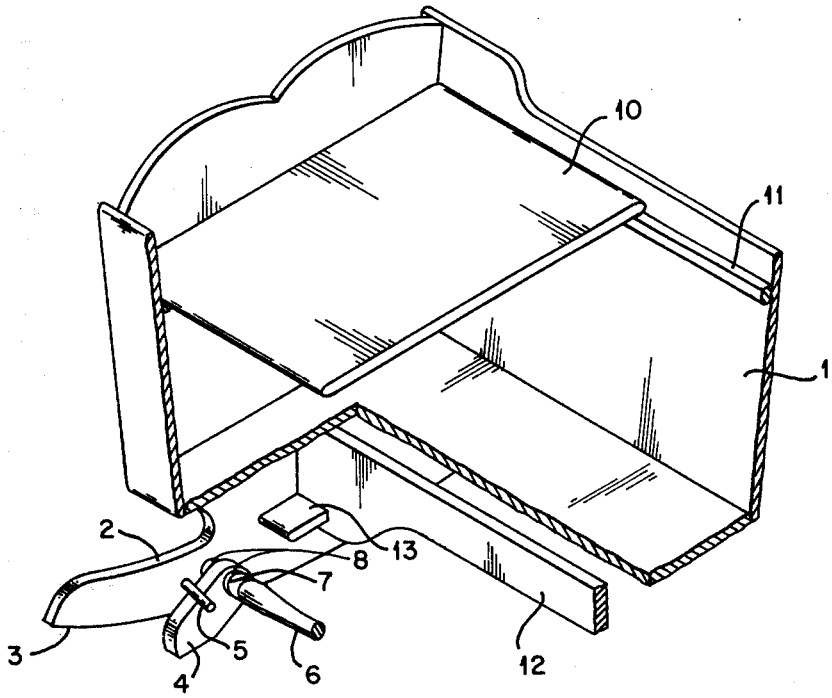
FIG. 3 is an oblique, partially cut-away, view of the embodiment of the invention shown in FIGS. 1 and 2 illustrating in greater detail construction of the device.

Also visible in FIG. 1 are the removable top covers 10 which may be put in place when the cradle has been converted to its stable configuration. The conversion is made by pivoting the legs 4 downward into engagement with the floor or other surface to support the rocker surface 3 out of contact with the floor, as illustrated. Cover portions 10 may be supported in the interior of the body 1 by support bars or strips 11 as shown and the confined or enclosed space thus created may be utilized as a storage chest or other suitable function with the top surface of the cover 10 forming a table surface on which articles can be placed.

As shown in greater detail in FIG. 2, the cover portion 10 may be divided into several segments as desired, since this improves the ease of utilization and allows individual sections of the body portion 1 to be covered or uncovered at will. However, the cover 10 could be made of a single piece of material instead. The upper ledge, or top surface of the head end portion of the cradle, is elevated in the design illustrated and an additional top surface cover 10 may be added as shown in FIG. 2 to provide a raised table surface above the area of the main closed compartment area as shown.

Also shown in FIG. 2 is the transverse cradle support 12 which serves to make a rigid structure of the main body 1 together with the rockers 2. Transverse vertical support 12 and rockers 2 are guled and/or screwed together and a horizontal stabilizer bar 13 is added to further strengthen the connection between the transverse vertical support 12 and the rockers 2. These are shown as the horizontal stabilizers 13.

As shown in FIG. 2, the pivoting legs 4 are mounted on axle or pivot portions 9 of transverse support shaft or brace means 6. The support shaft 6 has an enlarged shoulder surface portion 7 at both ends thereof and each leg 5 has an aperture through which a turneddown portion of brace 6 to create an axle, or pivot, 9 passes. Both faces of each leg 4, where the pivot 9 passes through it, are surfaced with washers 8 to prevent digging, gouging, etc., of the surface of the legs as they pivot. The washers also provide a large and rigid bearing surface portions of the leg 4 to take up transverse and torsional loads and distribute them over a large surface of the leg and the cooperating enlarged shoulder 7 of the support shaft 6 as well as over a large surface of the rockers 2. It may easily be seen that pivot 9 and the aperture in each leg 4 form a pivot bearing for the leg.

Shaft or brace 6 serves a dual function of not only vertically supporting the legs 4, but also of providing an improved torsional support for the legs. It also serves as a spacer and reinforcing member for the rockers 2 which it joins together at the inner surfaces of their opposite ends as shown.

Also shown is a wedging and locking pin 5 for each of the legs 4. Locking pin 5 is angled slightly downward to create a cam surface so that a reaction force between it and a leg 4 will be generated tending to wedge to leg 4 between the pin 5 and the inner surface of rocker 2 whenever the leg is in its engaged position in contact with the floor. This serves to wedge the leg firmly between the shoulder 7 of shaft 6 and the surface of rocker 2 so that loads applied transverse to the longitudinal axis of the cradle are taken up and the legs do not wobble or othersise lead to unstable support, which is often the case where the legs 4 are simply pivoted on a screw or other means without the wedging lock pin 5 and without the major contribution introduced by the transverse shaft or brace 6 with its enlarged shoulder portions 7 to hold the top portion of each leg 4 in a rigid position. The preferred wedge pin 5 is shown affixed to the rocker 2, but any suitable portion of the cradle body would suffice as a location for mounting the cam surface bearing element shown as pin 5. For example, the cradle bottom could serve as a suitable point for attaching a cam surface wedge.

Turning to FIG. 3, the details of construction as shown in FIGS. 1 and 2 are viewed as an oblique and cut-away view so that the construction may be better understood. In FIG. 3 it may be seen that the longitudinal support shafts at the pivots 9 of axles 6 pass through the apertures in the upper ends of each leg 4 and into the rocker elements 2. Washer 8 are positioned on each face of leg 4 where the pivot 9 of axle 6 passes through it and an enlarged shoulder portion 7 is utilized on each end of each shaft 6 where the pivot or circular cross section commences, to take up the bearing loads induced by loads or forces imposed on the cradle when it is in its locked or stable configuration. The wedging action of the angled wedge pin 5, and its resulting cam surface on the top surface of leg 4, is to lock leg 4 between the side surface of rocker 2 and pin 5 as clearly shown. This serves to rigidly unify leg 4 with rocker 2 and to stabilize the entire structure in addition to the stabilizing action of the transverse braces or shafts 6, so that the pivoting legs 4 are as integral a part of the rocker 2 as is practically attainable. The structure which results, with legs 4 engaged with the floor or support on which the cradle rests, is such that bumping, jostling, or pushing against the cradle body does not result in a wobbly-legged and unstable condition occurring. Instead, when covers 10 are in place, the cradle is converted to a very stable and rigid table or support cabinet on which articles may be placed or in which various articles may be stored in an attractive and functional manner after the cradle has been utilized as a rocker during the course of the infant occupant's development.

The transverse support 12 is shown affixed to the bottom panel of the cradle body 1 and to the rockers 2 and is further rigidified by the horizontal support members 13 which join transverse support 12 with the rockers 2.

Figure 4:
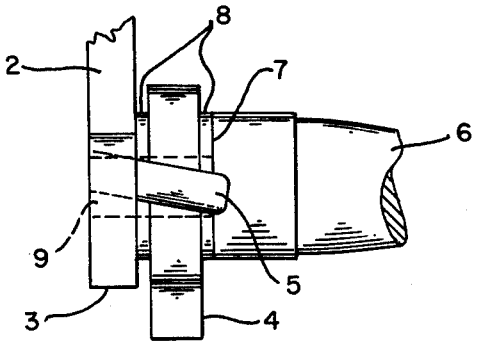
FIG. 4 is an enlarged view of the support area for an individual leg, together with the mounting and locking mechanism.

Turning to FIG. 4, an enlarged view of FIG. 2 in the area of an individual leg 4 is illustrated. It can be seen that horizontal transverse support axle or shaft 6 will rigidly unify the rockers 2 with each other and that the leg 4, which pivots on the turned-down circular axle section 9 of shaft 6, will be strongly supported by the thrust washers or bearing washers 8 on either face of leg 4 where the pivot 9 passes through it. The enlarged shoulder portion 7 on each end of the shaft 6 where the circular turned-down portion commences, serves the function, like the side surface of rocker 2, of providing a continuous surface to take up the loads imposed on the washers 8 and to resist any torsional or horizontal loads applied through the reaction of leg 4 to any forces applied to the cradle body. As shown in FIG. 4, the leg 4 is free to pivot about its pivot axle 9 and is not actually in contact with the rocker 2. However, upon assembly, sufficient clearance in the axle pivot 9 and the aperture in leg 4 through which it passes exists, together with clearance between the surfaces of the leg 4 and the washers 8 and the adjoining surfaces of the axle at shoulder 7 and the rocker 2 on its inner surface, so that leg 4 may be deflected very slightly and wedged in a locked position by the angled cam surface of the wedge lock pin 5. The wedging and the locking action of the angled lock pin 5 is such that, through continued use, if additional clearance results through wear on the bearing surfaces or leg 4 through which the axle pivot 9 passes, leg 4 will be forced into contact with the rocker 2 and will be hold locked and wedged in position so that a firm and rigid structure will result even when considerable wear has been introduced through continued pivoting and repivoting of the legs 4 or through repeated jostling, vibration, or forcing of the cradle during its use in the stable condition with the legs engaged.

It will be appreciated that the structure illustrated, and in particular with regard to the means of attaching and supporting the pivoting legs, is such that the torsional load introduced by endwise loads as well as by the vertical loads and torsional reactions due to weight of the cradle and its contents, will be rigidly supported on legs which are firmly and solidly locked in position so that the cradle may function as a table, chest, cabinet, or other suitable stable article of furniture. It will also be appreciated that the mode of employment of the pivoting legs 4 is an extremely easy one since the legs need only be pivoted downward into engagement with the lock pin 5, whereupon the weight of the cradle and its contents will tend to wedge and lock the legs firmly in position and the combined action with the support washers and shoulders will rigidly support the upper end of the leg 4 to make it as much an integral and rigid part of the rocker 2 and shaft 6 as can be obtained.

The preferred embodiment illustrated has four legs 4. However, only two legs are necessary to prevent rocking action, as will be easily understood. Also, it is preferred that the legs 4 be long enough to engage the tangent plane of the rockers 2 and to raise them off of the floor or other support surface. This requires the dimension of each leg 4 between the center line of its pivot aperture and its opposite end to be equal or greater than the distance between the convex arcuate surface 3 of the rocker 2 and the center line of pivot 9. Also in the preferred embodiment, the pivot bearing for each leg comprises the aperture in each leg in cooperation with the circular pivot portion of each shaft 6, however, roller or sleeve bearing might also be used, if desired, to improve the strength of the assembly.

It will be easily understood that in operation as a rocking cradle, the legs 4 are pivoted back in their disengaged position and are held latched out of the way by suitable magnet or friction or similar type latches illustrated as 14 and 15 in FIG. 1 and that the convex arcuate contoured surface 3 of each rocker 2 will then be in contact with the floor on which the cradle rests. Operation of the cradle in this configuration will normally be conducted without the removable covers 10 as will be appreciated, but when it is desired to convert the cradle to its stable configuration, the covers 10 may be employed as desired.

ADVANTAGES

Of considerable appeal in the present improved convertible cradle is the fact that the cradle need not be put aside once the infant has grown and use of a rocking cradle is discontinued. Instead of putting aside the investment in the piece of furniture as a cradle, the owner may convert the cradle to a fixed table or chest by pivoting the legs into position as described, and the resulting article of furniture will be stable and reliable without objectionable wobbliness in the legs. The cradle itself, in its outward appearance, is still largely preserved as a memento and is attractive for its outward appearance. However, another advantage is that the ease and stability of converting from rocking to fixed operation and back again, makes it attractive for re-use since it is possible that continued use of the rocking cradle action may be resumed as desired at any time.

While the invention has been particularly shown and described with reference to a preferred embodiment thereof, it will be understood by those of skill in the art that various changes in form and details may be made therein without departing from spirit and scope of the invention.

What is claimed is:

1. An article of furniture convertible for fixed or rocking actions, comprising:

a cradle body means having ends, side walls and a bottom panel for supporting an infant or other contents;

at least two arcuately edged rocker means affixed to said body with said arcuate edges having a convex shape relative to the bottom panel of said body and being disposed tangent to a common plane;

at least two brace means, each connecting and joining an inner face at the outer end of said rocker means to the oppositely disposed inner face at the outer end of each of said other rocker means;

said brace means being provided with circular cross-sections near their said junctures with their outer portions of said rockers;

at least two leg means for contacting said common plane to which the arcuate edges of said rockers are tangent, each said leg means having, near one end thereof, a circular pivot bearing aperture with an inside diameter to accommodate the outside diameter of the circular cross-section of said brace means, the circular cross-section of each said brace means being assembled to pass through, and form a pivot bearing with, the aperture in said leg means and then into the end of said rocker; and said leg means being pivotable on said pivot bearing to position the ends of said legs opposite said ends having said pivot bearing aperture into or out of contact with said common tangent plane of said rockers, lock means for locking said pivotable leg means in a fixed position relative to said rockers and in contact with said common tangent plane of said rockers, said locking means comprises an angled cam surface element rigidly affixed in a position to be contacted by a surface of said pivotable leg means when said leg means has been pivoted into contact with said tangent plane of said rockers, the cam surface of said lock means being oriented to wedge said pivoting leg means between said cam surface and toward the surface of said rocker means.

2. Apparatus as described in claim 1, further comprising:

a flat surface being formed on each end of each said brace means at the point where said circular cross sectioned portion commences; and thrust washers disposed on the opposite faces of said pivoting leg at locations between the interface said leg and said rocker, and between the opposite face of said leg and said surface formed on the end of said brace means.

3. Apparatus as described in claim 2, wherein:

each said leg means has a length from the center of said aperture to the distal end of said leg which is greater than or equal to the distance between the arcuate surface of said rocker and the center line of said circular cross-section of said brace means so that, upon proper pivoting of said legs, the distal ends thereof contact said common tangent plane and raise said arcuate surfaces of said rockers out of contact with said plane.

4. Apparatus as described in claim 1, further comprising:

rigid planar cover means for covering said cradle body and enclosing the contents thereof;

said cradle body being provided with support means for said rigid cover means.

5. Apparatus as described in claim 1, further comprising:

rigid planar cover means for covering said cradle body and enclosing the contents thereof;

said cradle body being provided with support means for said rigid cover means.

6. Apparatus as described in claim 3, further comprising:

rigid planar cover means for covering said cradle body and enclosing the contents thereof;

said cradle body being provided with support means for said rigid cover means.

* * * * *